US007575037B2

(12) United States Patent
Jorgensen

(10) Patent No.: US 7,575,037 B2
(45) Date of Patent: Aug. 18, 2009

(54) OVERHEAD BI-FOLD LATCHING DOOR

(76) Inventor: N. Valde V. Jorgensen, 200A Progress Dr., Burgaw, NC (US) 28425

( * ) Notice: Subject to any disclaimer, the term of this patent is extended or adjusted under 35 U.S.C. 154(b) by 334 days.

(21) Appl. No.: 11/433,814

(22) Filed: May 12, 2006

(65) Prior Publication Data

US 2007/0261800 A1 Nov. 15, 2007

(51) Int. Cl.
*E05D 15/26* (2006.01)

(52) U.S. Cl. ..... 160/207; 160/213; 160/193; 160/229.1

(58) Field of Classification Search ..... 160/213, 160/207, 229.1; 16/366, 368, 369
See application file for complete search history.

(56) References Cited

U.S. PATENT DOCUMENTS

| | | | | | |
|---|---|---|---|---|---|
| 428,402 | A | * | 5/1890 | Morris | 16/366 |
| 1,144,404 | A | * | 6/1915 | Williams | 16/260 |
| 1,155,161 | A | * | 9/1915 | Ramsey | 49/246 |
| 1,209,360 | A | * | 12/1916 | Tomkinson | 160/189 |
| 2,205,484 | A | * | 6/1940 | Hunter | 16/350 |
| 2,511,777 | A | * | 6/1950 | Kujawa | 16/366 |
| 3,493,033 | A | | 2/1970 | McGirr | |
| 4,088,172 | A | | 5/1978 | Pollock | |
| 4,243,091 | A | | 1/1981 | DeVore | |
| 4,261,409 | A | | 4/1981 | DeVore | |
| 4,448,232 | A | * | 5/1984 | McQueen et al. | 160/207 |
| 4,545,418 | A | | 10/1985 | List et al. | |
| 4,637,446 | A | * | 1/1987 | McQueen et al. | 160/207 |
| 5,168,914 | A | | 12/1992 | Keller | |
| 5,343,923 | A | * | 9/1994 | Keller | 160/207 |
| 5,560,658 | A | * | 10/1996 | Coolman et al. | 292/28 |
| 5,782,283 | A | | 7/1998 | Kendall | |
| 5,884,363 | A | | 3/1999 | Tofts | |
| 6,006,817 | A | | 12/1999 | Stone et al. | |
| 6,098,697 | A | * | 8/2000 | Krupke et al. | 160/229.1 |
| 6,199,617 | B1 | * | 3/2001 | Schweiss | 160/193 |
| 6,293,353 | B1 | * | 9/2001 | Poole | 172/776 |
| 6,547,292 | B1 | * | 4/2003 | Keller | 292/242 |
| 6,626,226 | B2 | * | 9/2003 | Whitley | 160/236 |
| 6,866,080 | B2 | | 3/2005 | Schweiss | |
| 7,029,041 | B2 | * | 4/2006 | Keller | 292/242 |
| 7,219,711 | B2 | * | 5/2007 | Keller et al. | 160/213 |
| 2001/0007276 | A1 | * | 7/2001 | Schweiss | 160/207 |
| 2005/0199355 | A1 | * | 9/2005 | Keller et al. | 160/213 |
| 2006/0027345 | A1 | * | 2/2006 | Briscoe et al. | 160/213 |

* cited by examiner

*Primary Examiner*—Katherine W Mitchell
*Assistant Examiner*—Jaime F Cardenas-Garcia
(74) *Attorney, Agent, or Firm*—MacCord Mason PLLC

(57) ABSTRACT

An overhead door with improved biasing means and automatic locking means includes two panels which are substantially horizontal when the door is raised and vertically aligned when the door is closed. An expandable hinge at the interface of the door panels allows the lower panel to move vertically when the door is in the lowered position with the upper end of the lower door panel is spaced from the lower end of the upper door panel. Either the lower end of the upper panel is tapered downwardly toward its outer edge, or the upper end of the lower panel is tapered upwardly toward its outer edge so that the outer edges of the panel ends contact first, biasing the interface of the panels outwardly, when the door is raised. The door also includes a latch that is engaged upon lowering the lower panel relative to the upper panel.

16 Claims, 6 Drawing Sheets

OVERHEAD BI-FOLD LATCHING DOOR

BACKGROUND OF THE INVENTION (1) Field of the Invention

The present invention relates to an improved overhead bi-fold door, and in particular to a bi-fold door having a biasing means for initially urging the interface of the door panels outwardly and a latching means that is automatically engaged when closing the door.

(2) Description of the Prior Art

Overhead bi-fold doors, particularly doors of the type used to close large building openings, are generally comprised of upper and lower door panels, with the lower end of the upper panel being hingedly attached to the upper end of the lower panel. The upper edge of the upper panel is hingedly attached to the lintel or header of the door frame. A drive means, generally in the form of a cable that extends from the lower part of the door to an overhead winch is used to raise and lower the door.

The door panels are vertically aligned when in the closed position and in a generally horizontal alignment when the door is open, with the hinged intersection of the door panels extending outwardly. The lower corners of the lower door panel are constrained to move vertically upwardly during opening and closing of the door, generally by attached rollers that extend into tracks along one or both sides of the door frame.

Designers of overhead bi-fold doors face two major challenges. First, since the opening force on the door is vertically upward, and since the door panels are vertically aligned, some provision must be made to initially urge or "kick" the hinged interface of the door panels, i.e., the center of the door, outwardly to enable folding of the doors. Generally, some complex mechanical linkage is used as the biasing mechanism, or a wedge may be positioned between the inner side of the door and the cable so that the cable exerts an outward force against the door.

Second, some locking or latching mechanism must be provided to prevent unauthorized opening of the door when it is closed. Preferably, the latching mechanism is automatically engaged when the door is closed. Generally, the latching mechanism is comprised of a latching arm carried on one of the door panels and a mating latching member mounted on the door frame. Some mechanism, such as a spring or lever is commonly used to move the arm into latching engagement with the latching member as the door is closed.

Neither the biasing means nor the latching mechanisms of prior art overhead bi-fold doors has proven to be entirely satisfactory. Therefore, there is a continuing need for improvements in both aspects.

SUMMARY OF THE INVENTION

The present invention is directed to an overhead bi-fold door having an improved biasing means to initially urge the center of the bi-fold door outwardly at the beginning of the door opening. The invention is also directed to a latching mechanism that is automatically engaged upon closing of the door. The invention is also directed to bi-fold doors incorporating both of these features.

Generally, the overhead bi-fold door of the present invention is comprised of two usually equally dimensioned, upper and lower panels, each having an outer face, an inner face, opposed sides, a top end, and a bottom end. The panels are sized to cover a building opening surrounded by a door frame having a lintel or header and side posts.

The door has closed or lowered and open or raised positions, with the panels being vertically aligned in the closed position and generally horizontal in the raised position. The top of the upper panel is adapted for hinged connection to the door frame header, while the bottom of the upper panel is hinged to the top of the lower panel so that the center of the door can fold outwardly, i.e., in the direction of the outer faces of the panels.

The bottom of the lower panel is attached to door frame side posts so that the bottom can only move along a vertical pathway during opening and closing of the door. Generally, this is achieved by roller tracks mounted on the frame posts, with rollers mounted on either bottom corner of the door projecting into the tracks.

While provision may be made to enable manual opening of the door, particularly in the event of a power failure, the door normally includes a motor driven opening mechanism comprised of a winch mounted above and behind the inner side of the door, with a cable extending to near the bottom of the door. Dual cables may extend from the winch to either side of the door.

Rotation of the winch pulls on the cable or cables to urge the door upwardly causing the center of the door to move outwardly under the urging of a biasing means and moving the bottom edge of the door vertically upward until the door panels are in a generally horizontal alignment. The prior art describes numerous winch and cable arrangements for use in opening overhead bi-fold doors and the particular winch and cable arrangement used for this purpose does not represent a unique aspect of the present invention.

Unlike prior art bi-fold doors the door of the present invention utilizes an extendable hinge, i.e., a hinge that permits vertical movement of the door panels relative to each other upon closing. This unique hinge mechanism, along with other features described herein makes possible the improved biasing means of the present invention, as well as the automatic latching mechanism.

More specifically, the extendable hinge of the invention is attached to the bottom of the upper door panel and the top of the lower door panel, but is configured so that the lower panel is permitted to move vertically relative to the upper panel when the panels are moved into vertical alignment. To enable this movement, one of the panel interface ends, i.e., the end of the panel toward the other panel, is angled toward the outer side of the door panel so that the outer edge of the interface end is closer to the other panel than the panel inner end. That is, the upper panel lower or interface end may be inclined downwardly from its inner edge to its outer edge, or the lower panel upper or interface end may be inclined upwardly from its inner edge to its outer edge. As a result of the hinge configuration described below and the panel end configuration, the lower panel is permitted to move downwardly to separate from the upper panel when the door is closed.

When the door is initially being opened, the lower panel is raised upwardly into contact with the upper panel. Upward pressure and the angularity of at least one of the panel ends urges the panel interface outwardly, acting as a biasing means to move the door panels out of their vertical alignment so that the door can open with only the vertical force. The term "contact" as used herein encompasses direct contact of the panels as well as indirect contact via the hinges.

The hinge may be of different configurations. In a preferred embodiment, the hinge is of a "Z" configuration with three hinge plates joined by two hinge pins. An upper hinge plate is attached to the bottom of the top panel and a lower hinge plate is attached to the top of the lower panel. An intermediate hinge plate joins the upper hinge plate with a hinge pin at the outer side of the panels, and the lower hinge plate with a hinge pin at the inner side of the panels. While the lower plate can be of a length, i.e., the direction transverse to the hinge pin, approximately equal to the thickness of the panel, the upper and intermediate plates have a length greater than the upper panel width, with the upper panel being attached adjacent the distal end of the plate, i.e., the end of the plate opposite the hinge pin. As a result, the upper and intermediate plates project beyond the front of the panels with the hinge pin joining the upper and intermediate plates being spaced from the outer faces of the panes.

When describing mounting of a plate at the "top" or "bottom" of a panel, it will be understood that the plate, while normally attached to the upper or lower surface of the panel, as the case may be, can alternatively be attached to the immediately adjacent front or back faces of the panel.

In this embodiment, when the door is closed and the lower panel is lowered relative to the upper panel, the hinge will be extended with the upper and lower plates spaced from each other and the intermediate plate at an angle joining the upper and lower plates. When the door is initially opened, the lower panel will be raised until it contacts the upper panel via the hinge, closing the gap between the panels. The hinge then opens at the hinge pin joining the lower plate to the intermediate plate, permitting the door to fold outward. The hinge may also include a locking mechanism to prevent opening of the hinge to its extended position when the door is moved to the opened position.

An alternative hinge embodiment comprises a first hinge plate attached to the upper plate and a second hinge plate attached to the lower panel, with the plate being joined to each other by a hinge pin. At least one of the plates is vertically adjustable relative to the panel to which it is attached. For example, one of the plates can be carried within a sleeve attached to the rear face of one of the panels, e.g., the upper panel, while the second hinge is attached to the top of the bottom panel, with the first and second hinge plates being joined by a hinge pin adjacent the inner side of the door. As described above, at least one of the panel ends is inclined toward the outer face of the panel so that the outer edge of the inclined panel first contacts the end of the other panel.

When this embodiment is used and the door is closed and the lower panel is lowered relative to the upper panel, the slidable hinge plate will move relative to the panel to which it is attached permitting the panels to separate. When the door is being opened, the lower panel will be raised until it contacts the upper panel, causing the slidable hinge plate to move relative to the panel to which it is attached and closing the gap between the panels and biasing the interface on the panel outwardly. The hinge then opens at the hinge pin joining the plates, permitting the door to fold outward. Other configurations permitting a similar function will occur to one skilled in the art.

The door can also include an automatic latching mechanism comprised of a post member attached to a door post and a panel member attached to the lower door panel. The members are arranged so that the panel member is lowered behind the post member when the door is closed and the lower panel is moved downwardly, securely locking the door. When the lower panel is raised to the biasing position in preparation for opening of the door, the panel member is moved upwardly from behind the post member, unlocking the door. If desired, the panel member can be carried along an incline during closing to press the door firmly against the door post. It will be understood that the biasing means and locking means of the invention can be used separately or in combination.

DETAILED DESCRIPTION OF THE INVENTION

Figure 1:
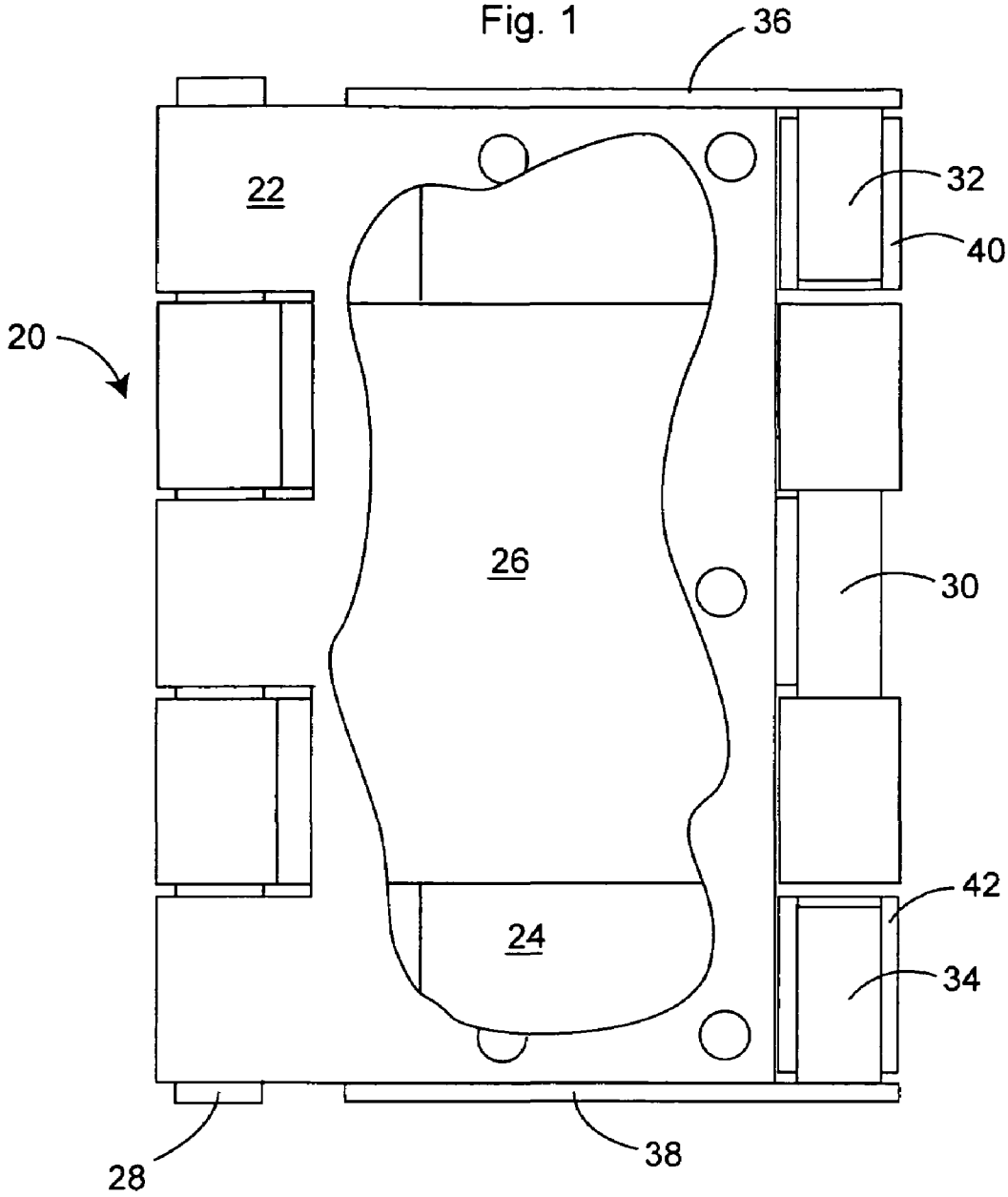
FIG. 1 is a top view of a preferred hinge for joining door panels with sections cut away for illustration purposes.

In the following description, terms such as horizontal, upright, vertical, above, below, beneath, and the like, are used solely for the purpose of clarity in illustrating the invention, and should not be taken as words of limitation. The drawings are for the purpose of illustrating the invention and are not intended to be to scale.

As shown in the illustrations of the preferred embodiment, overhead bi-fold door, generally 10, supported by door frame 12, is comprised of upper panel 14 and lower panel 16, which are normally of the same dimensions. Panel 14 is joined at its lower end to the upper end of panel 16 by a plurality of hinges. A preferred hinge, generally 20, is best illustrated in FIGS. 1-5.

Figure 5:
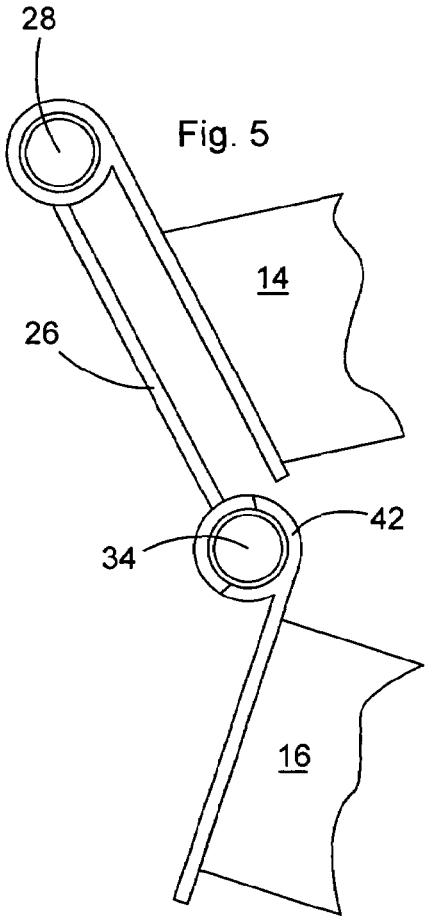
FIG. 5 is a sectional side view of the hinge of FIG. 1 joining upper and lower door panels with the panels in their raised position.

Hinge 20 is comprised of upper plate 22, bottom plate 24 and intermediate plate 26. Plates 22 and 26 are pivotally attached at the outer end of plate 22 by hinge pin 28, while plate 24 and 26 are pivotally attached at the inner end of plate 24 with hinge pin 30. Plates 22 and 24 include mating latching members to prevent separation of plates 22 and 24 when hinge 20 is in its open position as illustrated in FIG. 5.

Specifically, plate 22 includes a pair of inwardly directed, axially aligned cylindrical members 32 and 34, carried on side supports 36 and 38, respectively of plate 22. Plate 38 is shown with cut away in FIG. 2 and removed from plate 22 in FIGS. 3-5 for clarity of illustration. Plate 24 includes a pair of upwardly open semi-cylindrical mating members 40 and 42, sized to receive members 32 and 34, respectively. Members 32, 34, 40 and 42 are all axially aligned with hinge pin 30. When hinge 20 is in the closed position illustrated in FIG. 5, plates 22, 24 and 26 are in generally parallel, with members 32, 34, 40 and 42 axially aligned with hinge pin 30. Members 32 and 34 are within member 40 and 42, respectively.

Plate 22 has a panel attachment end opposite its hinged end and is of a length greater than the thickness of the panel to which it is attached with the panel being attached adjacent the plate distal end, i.e., the plate end opposite the hinged end. Similarly plate 26 is of approximately the same length as plate 22 so that plate 26 can extend between hinge pins 28 and 30. As a result, outer segments of plates 22 and 26 extend beyond the outer faces of panels 14 and 16 and hinge pin 28 is spaced from panels 14 and 16.

Figure 3:
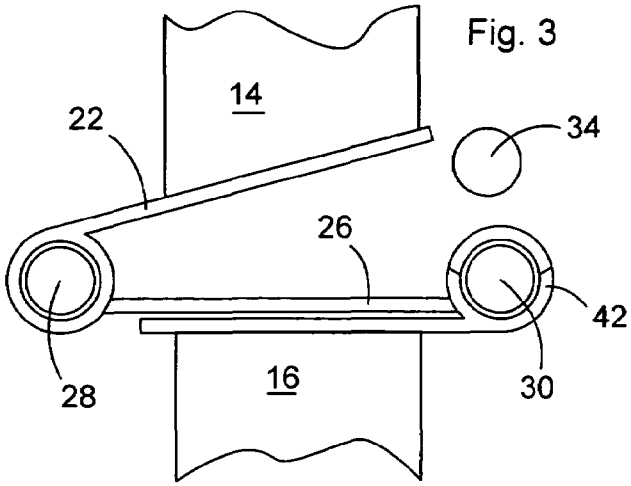
FIG. 3 is a sectional side view of the hinge of FIG. 1 joining upper and lower door panels in their closed position.

When door 10 is in its fully closed position, panels 14 and 16 are vertically aligned with panel 16 being spaced beneath panel 14. This spacing is made possible by hinge 10 as illustrated in FIG. 3. Specifically, when door 10 is fully closed, upper plate 22 is lifted at an angle from plates 24 and 26, creating a space between panels 14 and 16 due to the extension of plates 22 and 26 beyond the outer faces of panels 14 and 16. In this position, latching members 32 and 34 are lifted out of engagement with latching members 40 and 42.

Figure 2:
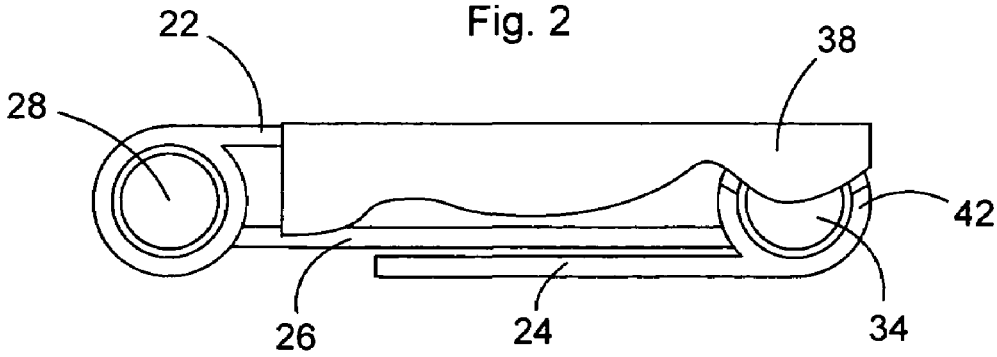
FIG. 2 is an end view of the hinge of FIG. 1 with sections cut away for illustration purposes.
Figure 4:
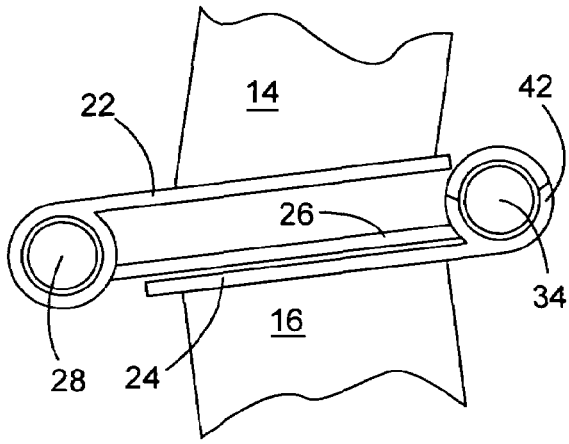
FIG. 4 is a sectional side view of the hinge of FIG. 1 joining upper and lower door panels with the lower panel in its initially opened position.

When lower panel 16 is raised by a lifting mechanism to be described below, plate 22 is returned to its closed position as shown in FIGS. 2 and 4, and latching members 32 and 34 are moved into engagement with latching members 40 and 42. As the opening of door 10 continues, plate 26 pivots upwardly and plate 24 pivots downwardly about hinge 30.

Upon pivoting, semi-cylindrical rotatable members 40 and 42 rotate about members 32 and 34, bringing portions of members 40 and 42 above members 32 and 34, thereby preventing members 32 and 34 from separating from members 40 and 42. As a result, plate 22 is locked with plate 26, preventing plate 22 from moving to its open position when hinge 20 is opened, thereby maintaining panels 14 and 16 in correct alignment.

Figure 6:
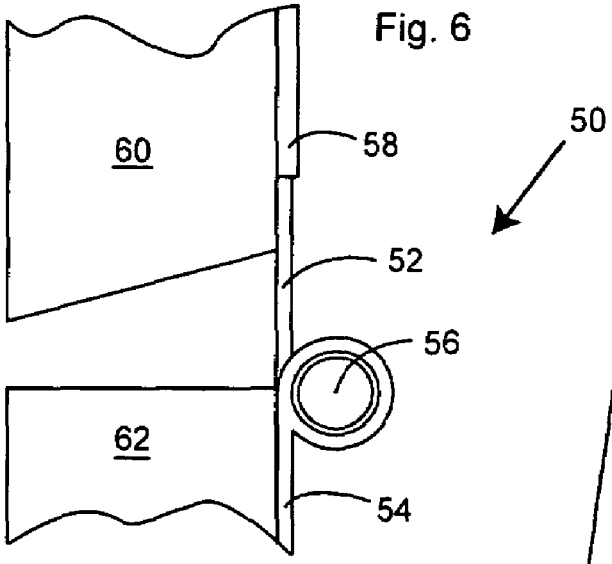
FIG. 6 is a sectional side view of an alternative hinge joining upper and lower door panels in their closed position.
Figure 7:
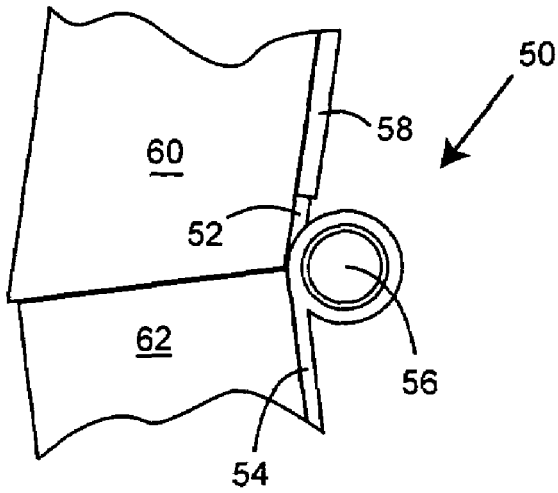
FIG. 7 is a sectional side view of an alternative hinge joining upper and lower door panels with the lower panel in its initially opened position.
Figure 8:
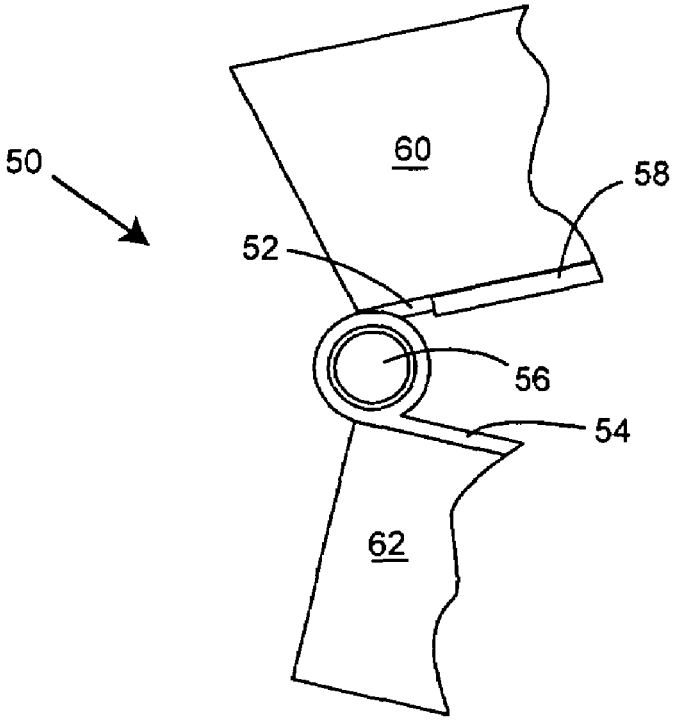
FIG. 8 is a sectional side view of an alternative hinge joining upper and lower door panels with the panels in their raised position.

FIGS. 6-8 illustrate an alternative hinge, generally 50, which enables movement of the two panels in a manner similar to that enabled by hinge 20. Hinge 50 is comprised of upper hinge plate 52 and lower hinge plate 54 pivotally attached at hinge pin 56. Plate 52 is slidable mounted within a receiver such as sleeve 58 and is slidable between a lowered position as shown in FIG. 6 and a raised position as shown in FIG. 7. Sleeve 58 is vertically aligned at the back of panel 60, while hinge plate 54 is attached to panel 62. While plate 54 is shown attached to the back of panel 62, it will be understood that plate 54 can alternatively be attached to the top of panel 62.

In its lowered position the lower end of upper panel 60, which is inclined downwardly toward the outer face of the door, is spaced from the upper end of panel 62, with hinge plate 52 being in its lowered position. As lower panel 62 is raised into contact with panel 60, the angularity of the lower end of panel 60 biases the panels outwardly at their interface. It will be understood that inclining the end of panel 62 instead of, or in addition to, panel 60 will achieve the same result. Further movement of the panels moves the door to the open position shown in FIG. 8.

Figure 9:
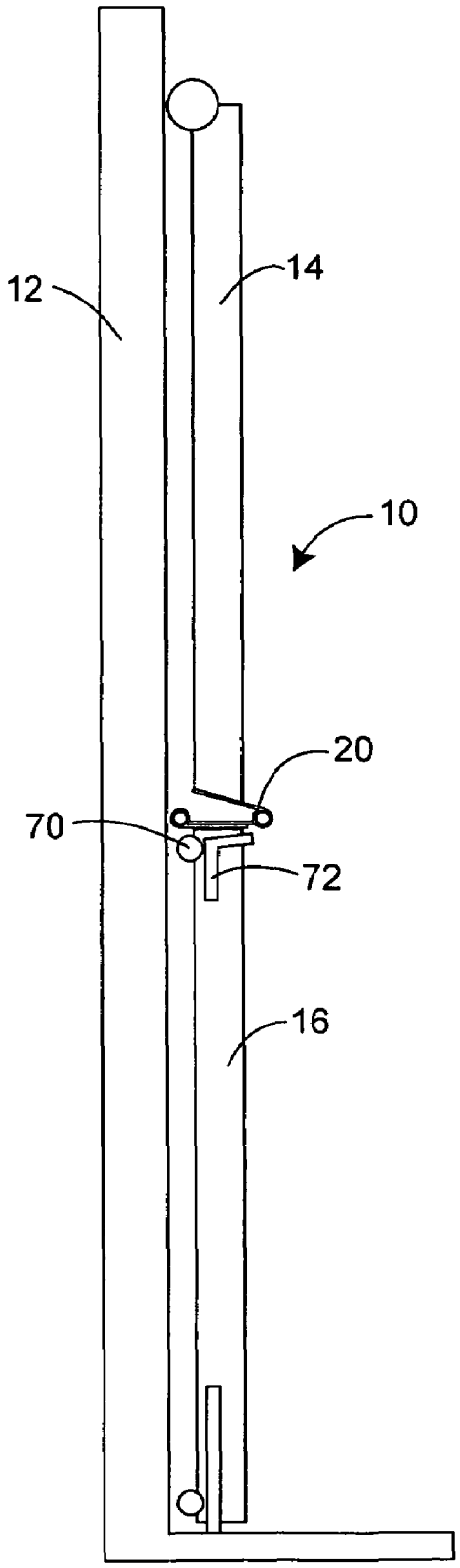
FIG. 9 is a side view of an overhead bi-fold door supported by a door frame with the door in the fully closed position and the automatic lock engaged.
Figure 10:
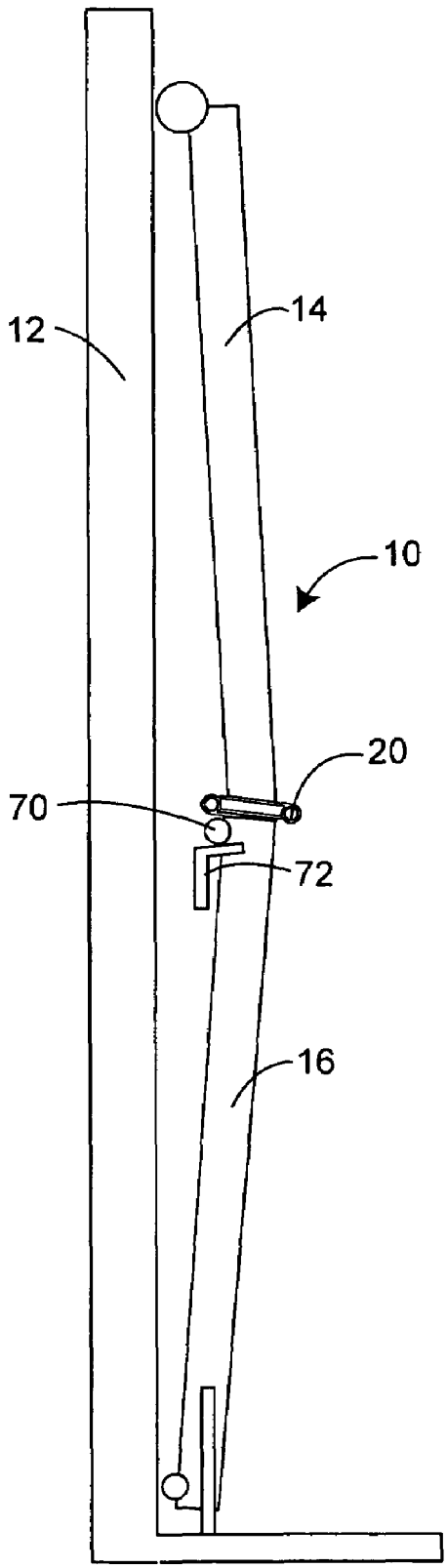
FIG. 10 is a side view of an overhead bi-fold door supported by a door frame with the door in the initially opened position and the automatic lock disengaged.

The overhead bi-fold door of the present invention with its unique hinge configuration also enables automatic latching of the door when the door is moved to its fully closed position. As illustrated in FIGS. 9 and 10, panel 16 can include a first latching member 70, preferably in the form of a fixed horizontal arm, and frame 12 can include a cooperating second latching member 72, preferably in the form of a barrier spaced from door frame 12, so that arm 70 is insertable behind member 72.

When door 10 is moved to its fully closed position and panel 16 is lowered, first member 70 automatically slides downwardly behind member 72. Outer movement of the intersection of panels 14 and 16, and resultant opening of door 10, is thereby prevented. However, when panel 16 is moved to its initially open position, member 70 is moved upwardly so that its forward movement is no longer prevented by member 72, thereby allowing door 10 to open.

Movement of door 10 between fully closed, initially opened, and fully raised positions is enabled by a cable 76 and winch 78, which is powered by a suitable means such as an electric motor. Cable 76 first extends from winch 78 around a lower pulley 80 which is constrained for movement along a vertical pathway, e.g., by being attached to a follower or wheel within a vertical trackway. While only one cable is shown, it will be understood that two cables, one on each side of door 10 may be used. Cable 76 then extends upwardly in front of pulley 82 at the upper end of panel 16, behind and around pulley 84 on the lower end of panel 14 and then downwardly in front of pulley 82 to a stationary attachment 86.

Figure 11:
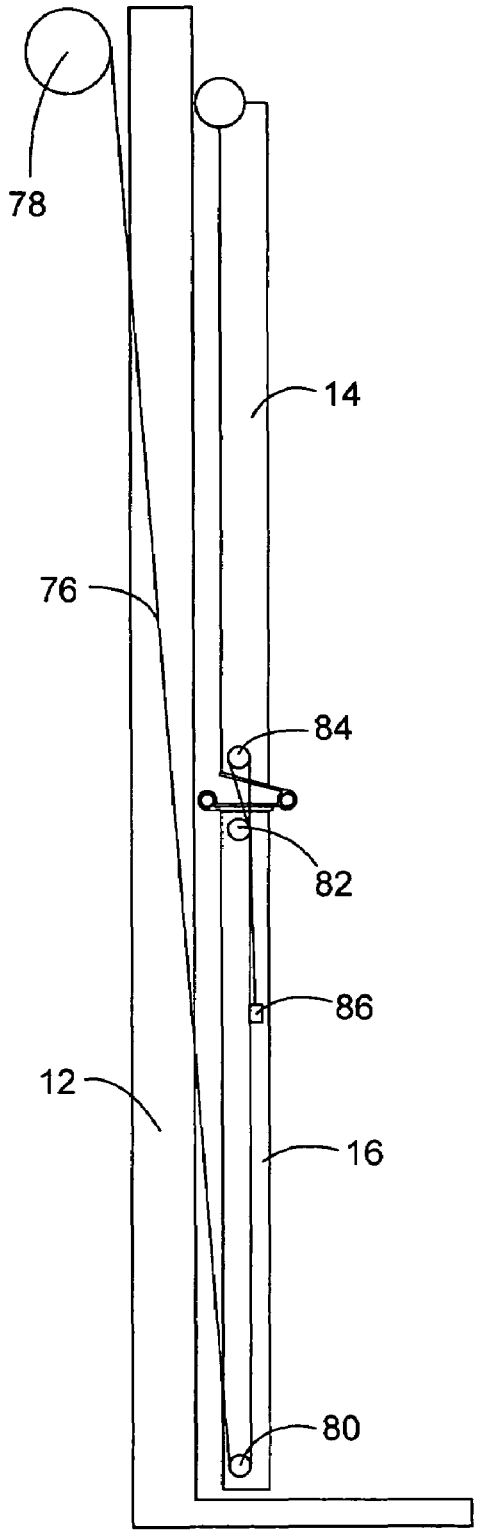
FIG. 11 is a side view of an overhead bi-fold door supported by a door frame with the door in the fully closed position showing the cable drive mechanism.
Figure 12:
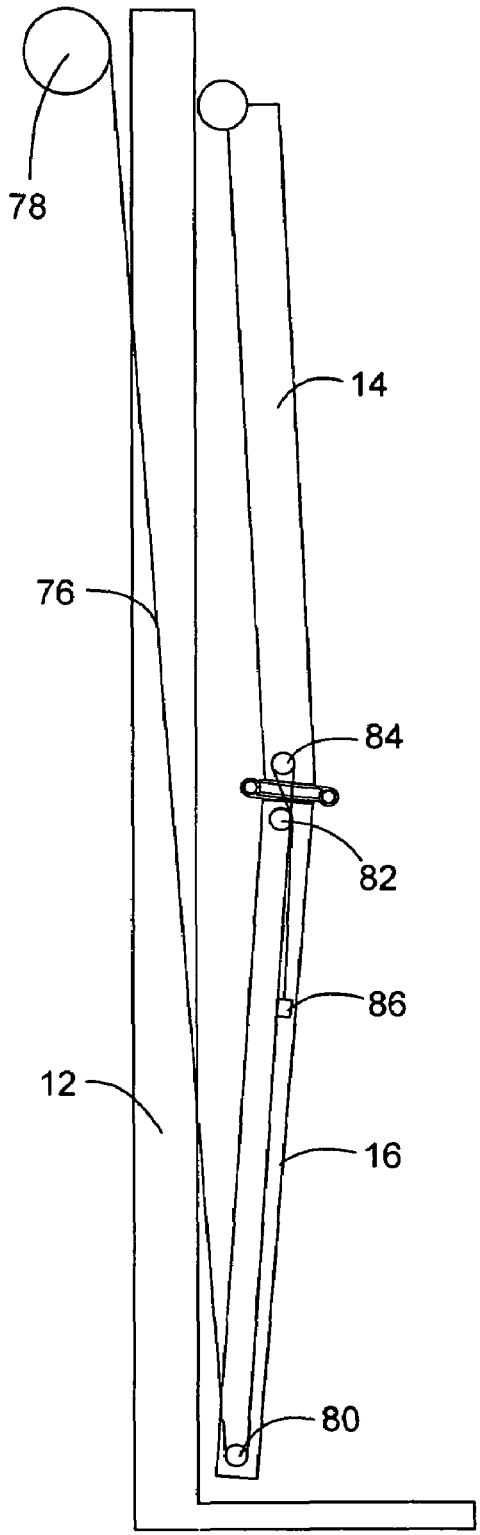
FIG. 12 is a side view of an overhead bi-fold door supported by a door frame with the door in the initially opened position showing the cable drive mechanism.

When door 10 is in its fully closed position and cable 76 is in its fully extended position, panel 16 is in its fully lowered position as shown in FIG. 11, spacing the lower end of panel 14 from the upper end of panel 16. As illustrated in FIG. 9, door 10 is latched in this position.

Figure 13:
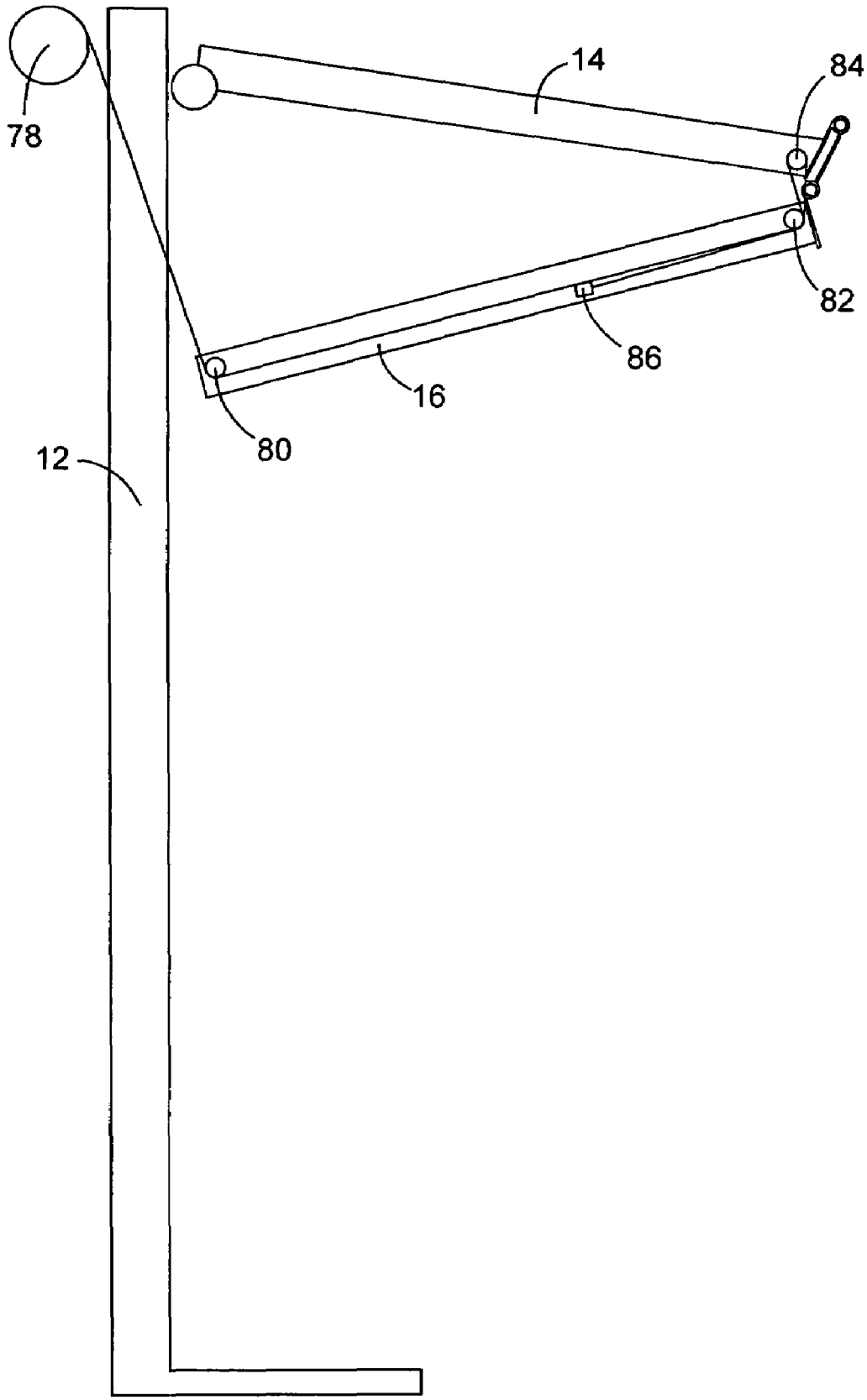
FIG. 13 is a side view of an overhead bi-fold door supported by a door frame with the door in the fully raised position showing the cable drive mechanism.

As cable 76 is retracted, panel 16 is initially pulled upward until its interface end engages the outer edge of the interface end of panel 60. As a result of the upward pressure on panel 62 in combination with the configuration of the panel ends, the panel ends orient into parallel alignment, to urge or "kick" the interface of panels 60 and 62 outwardly, permitting opening of door 10. As cable 76 continues to retract, the lower end of panel 62 continues upwardly along the vertical track and door panels 14 and 16 are moved to the fully raised position illustrated in FIG. 13.

Thus, the unique hinging of the upper and lower panels of the overhead bi-fold door of the present invention enable two essential characteristics in a reliable and simple manner. First, with the hinge design and angle of one of the facing door panel ends toward the outer side of the door, the door can be urged outwardly at its center, i.e., the interface of the two panels, without the use of complex mechanisms. Second, a simple latching arrangement can be added to the door and door frame to automatically effect latching of the door as the door is closed and the lower panel is moved to its lowered position.

Certain modifications and improvements will occur to those skilled in the art upon a reading of the foregoing description. It should be understood that all such modifications and improvements have been deleted herein for the sake of conciseness and readability but are properly within the scope of the following claims.

What is claimed is:

1. A sectional overhead door having a raised position and a closed position comprising:

a) an upper door panel having a thickness defined by the distance between an inner face, and an outer face, said upper door panel including a lower interface end with an outer edge and an inner edge;

b) a lower door panel having a thickness defined by the distance between an inner face, and an outer face, said lower door panel including an upper interface end with an outer edge and an inner edge, said outer faces of said door panels being aligned in a vertical plane with the interface end of said lower door panel being angularly spaced from the interface end of said upper door panel when said door is in the closed position;

c) a hinge connecting the upper and lower door panels, said hinge permitting said lower panel to move vertically relative to said upper panel when said door is in the closed position, said hinge being of a "Z" configuration with three plates joined by two hinge pins, wherein an upper plate is attached to the lower interface end of said upper panel and a lower hinge plate is attached to the upper interface end of said lower panel with an intermediate plate joining said upper hinge plate with a hinge pin at the outer side of said panels and said lower hinge plate with a hinge pin at the inner side of said panels, wherein said upper and intermediate plates each have a respective length greater than said upper panel thickness; and d) drive means for raising said lower door panel to engage the inner edge of said upper door interface end with the inner edge of said lower door panel interface end and thereafter move said door to its raised position.

2. The door of claim 1, wherein said upper panel interface end is angled downwardly from its inner edge to its outer edge, whereby upward pressure and the angularity of said upper panel interface end urges said panel interface outwardly, acting as a biasing means to move said door panels out of their vertical alignment so that said door can open with only vertical force.

3. The door of claim 1, further including a locking means engaged upon vertical downward movement of said lower panel.

4. The door of claim 1, wherein said lower panel includes a lower end, said door further including a drive means for moving said lower panel lower end along a vertical pathway.

5. The door of claim 1, wherein said hinge includes a lock that is engaged when said door is in the raised position and opened when said door is in the lowered position.

6. A sectional overhead door having a raised position and a closed position comprising:

a) an upper door panel having a thickness defined by the distance between an inner face, and an outer face, said upper door panel including a lower interface end with an outer edge and an inner edge;

b) a lower door panel having a thickness defined by the distance between an inner face, and an outer face, said lower door panel including an upper interface end with an outer edge and an inner edge, said outer faces of said door panels being aligned in a vertical plane with the interface end of said lower door panel being angularly spaced from the interface end of said upper door panel when said door is in the closed position;

c) an extendable hinge connecting the upper and lower door panels, said hinge permitting said lower panel to move vertically relative to said upper panel when said door is in the closed position, said extendable hinge being of a "Z"configuration with three plates joined by two hinge pins, wherein an upper plate is attached to the lower interface end of said upper panel and a lower hinge plate is attached to the upper interface end of said lower panel with an intermediate plate joining said upper hinge plate with a hinge pin at the outer side of said panels and said lower hinge plate with a hinge pin at the inner sides side of said panels, wherein said upper and intermediate plates each have a respective length greater than said upper panel thickness; and d) drive means for vertically raising said lower door panel to engage the inner edge of said upper door interface end with the inner edge of said lower door panel interface end and thereafter move said door to its raised position.

7. The door of claim 6, further including a latching means engaged upon vertical downward movement of said lower panel.

8. The door of claim 6, wherein said lower panel includes a lower end, said door further including a drive means for moving said lower panel lower end along a vertical pathway.

9. The door of claim 6, wherein said hinge includes a lock that is engaged when said door is in the raised position and opened when said door is in the lowered position.

10. A sectional overhead door mounted in a door frame, said door having a raised position and a closed position comprising:

a) an upper door panel having a thickness defined by the distance between an inner face, and an outer face said lower door panel including a lower interface end with an outer edge and an inner edge, said lower interface end being angled downwardly from its inner edge to its outer edge;

b) a lower door panel having a thickness defined by the distance between an inner face, and an outer face, said lower door panel including an upper interface end, said outer faces of said door panels being aligned in a vertical plane with the interface end of said lower door panel being angularly spaced from the interface end of said upper door panel when said door is in the closed position;

c) a hinge includes an upper plate with an outer end, a lower plate with an inner end, and an intermediate plate, said intermediate plate being hinged to the outer end of said upper plate with a first hinge pin and to the inner end of said lower plate with a second hinge pin, said upper plate being attached to said upper panel and said lower plate being attached to said lower panel, wherein said upper and intermediate plates have a length greater than said upper panel width thickness; and d) drive means for vertically raising said lower door panel to engage the lower panel upper end with the inner edge of said upper door panel interface end and thereafter move said door to its raised position while moving the interface of said panels outwardly.

11. The door of claim 10, wherein said first hinge pin is spaced from the outer faces of said panels.

12. The door of claim 10, wherein said hinge includes a lock that is engaged when said door is in the raised position and opened when said door is in the lowered position.

13. The door of claim 10, further including a latching means engaged upon vertical downward movement of said lower panel.

14. The door of claim 13, wherein said latching means includes a frame member attached to said door frame and a panel member attached to said lower panel, said panel member engaging said frame member when said door is moved to its lowered position.

15. The door of claim 10, wherein said lower panel has a lower end moveable along a vertical pathway, and said drive means includes a retractable cable to move said lower panel along said vertical pathway.

16. The door of claim 10, wherein said hinge includes a lock securing said upper plate to said intermediate plate when said door is in the raised position.

* * * * *